US010529226B1

(12) United States Patent
Warren

(10) Patent No.: US 10,529,226 B1
(45) **Date of Patent: *Jan. 7, 2020**

(54) VEHICLE INTEGRATION WITH SECURITY AND/OR AUTOMATION SYSTEMS

(71) Applicant: Vivint, Inc., Provo, UT (US)

(72) Inventor: Jeremy B. Warren, Draper, UT (US)

(73) Assignee: Vivint, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/193,523

(22) Filed: Nov. 16, 2018

Related U.S. Application Data

(63) Continuation of application No. 15/925,242, filed on Mar. 19, 2018, now Pat. No. 10,134,271, which is a continuation of application No. 14/735,823, filed on Jun. 10, 2015, now Pat. No. 9,922,549.

(51) Int. Cl.
*G08C 17/02* (2006.01)

(52) U.S. Cl.
CPC ..... *G08C 17/02* (2013.01); *G08C 2201/30* (2013.01); *G08C 2201/93* (2013.01)

(58) Field of Classification Search
CPC .... G08C 17/02; G08C 23/04; G08C 2201/30; G08C 17/00; G08C 2201/92; G08C 2201/93; G08C 2201/20; G08C 2201/50; G08C 19/16; G08C 19/28
USPC ..... 340/12.54
See application file for complete search history.

(56) References Cited

U.S. PATENT DOCUMENTS 8,049,595 B2 11/2011 Olson et al.
8,165,527 B2 4/2012 Sims et al.
8,373,581 B2 2/2013 Hassan et al.
8,538,331 B2 9/2013 Jung et al.
8,988,221 B2 * 3/2015 Raji ..... G08B 25/008 340/541
9,019,111 B1 * 4/2015 Sloo ..... F24F 11/30 340/628
9,020,697 B2 * 4/2015 Ricci ..... H04W 4/21 701/36
9,082,239 B2 * 7/2015 Ricci ..... B60Q 1/00
9,306,809 B2 * 4/2016 Dawes ..... H04L 41/18
9,378,601 B2 6/2016 Ricci
9,380,507 B2 * 6/2016 Bradley ..... H04W 36/24
9,407,452 B2 * 8/2016 Warren ..... H04L 12/2807
(Continued)

FOREIGN PATENT DOCUMENTS

DE 19849195 A1 4/2000

OTHER PUBLICATIONS

English translation of the specification, claims and abstract for DE19849195. Apr. 27, 2000.

*Primary Examiner* — Mark S Blouin
(74) *Attorney, Agent, or Firm* — Holland & Hart, LLP

(57) ABSTRACT

A system and method for controlling a security and/or automation system using a aspects of a vehicle. The method may include receiving confirmation of a user's presence in the vehicle, receiving confirmation of vehicle operation, displaying on a display of the vehicle at least one control option for a security and/or automation system of a property monitored by the security and/or automation system, receiving at least one user input on the display related to the at least one control option, and transmitting instructions to control the security and/or automation system based on the at least one user input.

20 Claims, 12 Drawing Sheets

(56) References Cited

U.S. PATENT DOCUMENTS

| | | | | |
|---|---|---|---|---|
| 9,412,248 | B1 * | 8/2016 | Cohn | G08B 19/005 |
| 9,439,034 | B2 * | 9/2016 | Lott | H04W 4/021 |
| 9,449,442 | B2 * | 9/2016 | Bevan | G07C 9/00007 |
| 9,490,996 | B1 * | 11/2016 | Vijayrao | H04L 12/2809 |
| 9,508,247 | B2 * | 11/2016 | Lee | G08B 25/008 |
| 9,508,250 | B2 * | 11/2016 | Malhotra | G08B 29/185 |
| 2013/0231784 | A1 | 9/2013 | Rovik et al. | |
| 2014/0045482 | A1 | 2/2014 | Bisson et al. | |

* cited by examiner

900

VEHICLE INTEGRATION WITH SECURITY AND/OR AUTOMATION SYSTEMS

CROSS-REFERENCE TO RELATED APPLICATIONS

The present application is a continuation of U.S. patent application Ser. No. 15/925,242, filed Mar. 19, 2018, titled "VEHICLE INTEGRATION WITH SECURITY AND/OR AUTOMATION SYSTEMS," which is a continuation of U.S. patent application Ser. No. 14/735,823, filed Jun. 10, 2015, titled "VEHICLE INTEGRATION WITH SECURITY AND/OR AUTOMATION SYSTEMS," and assigned to the assignee hereof, the disclosures of which are expressly incorporated herein in their entirety by this reference.

BACKGROUND

The present disclosure, for example, relates to security and/or automation systems, and more particularly to integration of a vehicle computing system with security and/or automation systems for a home or other property.

Security and automation systems are widely deployed to provide various types of communication and functional features such as monitoring, communication, notification, and/or others. These systems may be capable of supporting communication with a user through a communication connection or a system management action.

Remote control of security and automation systems provides ways in which a property may be monitored and/or controlled when users are away from the property. Such controls are sometime available via a mobile computing device such as a smart phone or tablet computer. Traffic laws in some areas may prevent operation of such mobile computing devices while a person is operating a vehicle. As a result, there may be extended periods of time in which a user is unable to access and/or control a security and/or automation system from a remote location while the user is operating or in a vehicle.

SUMMARY

The present disclosure is directed to systems and methods for integrating a vehicle computing system, and in particular a display of a vehicle computing system, with a home security and/or automation system. One aspect of the present disclosure relates to linking a user's mobile computing device to a computing system of a vehicle the user is driving or occupying. Once the mobile computing device is linked to the vehicle computing device, the user's inputs to the vehicle display may generate instructions for remote operation of the home security and/or automation system. In some embodiments, the vehicle computing system confirms a link with the mobile computing device and confirms operation of the vehicle (e.g., the vehicle is moving), and then permits user inputs to the vehicle display for remote control of the home security and/or automation system. In other embodiments, the mobile computing device confirms the link to the vehicle computing system and confirms operation of the vehicle, and then permits user inputs to the vehicle display screen related to remote control of the home security and/or automation system.

In some embodiments, the user's mobile computing device communicates with the home security and/or automation system, while in other embodiments the vehicle computing device may communicate with the home security and/or automation system. At least some information displayed on the user's mobile computing device may also be displayed on the vehicle display after the mobile computing device is linked to the vehicle computing device. The vehicle display may act as an extension or proxy for the display of the mobile computing device to receive inputs from the user.

One embodiment is directed to a method for controlling a security and/or automation system using a vehicle. The method includes receiving confirmation of a user's presence in the vehicle, receiving confirmation of vehicle operation, displaying on a display of the vehicle at least one control option for a security and/or automation system of a property monitored by the security and/or automation system, receiving at least one user input on the display related to the at least one control option, and transmitting instructions to control the security and/or automation system based on the at least one user input.

The method may further include receiving geo location information relative to the property monitored by the security and/or automation system. A computing device of the vehicle may receive the confirmation of the user's presence and the vehicle operation and transmits the instructions. The vehicle may receive the confirmation of the user's presence from a mobile computing device carried by the user and linked to the vehicle. The vehicle may include a global positioning system operable to determine a geo location of the vehicle. The vehicle display may include a touch screen, and the at least one user input may include a touch input to the touch screen. Transmitting instructions may include communicating with the security and/or automation system via a mobile computing device. Transmitting instructions may include communicating wirelessly from the vehicle to a control panel of the security and/or automation system. The method may further include automatically displaying the at least one control option when a least one of the user's presence and vehicle operation is confirmed. The vehicle display may be paired to a mobile computing device, and the method may further include displaying on the vehicle display content shown on a viewable display of the mobile computing device.

A further embodiment is directed to an apparatus for controlling a home security and/or automation system using a vehicle. The apparatus includes a processor, memory in electronic communication with the processor, and instructions stored in the memory. The instructions are executable by the processor to link a mobile computing device with a display of the vehicle, confirm operation of the vehicle, display on a display of the vehicle at least one control option for the home security and/or automation system, receive at least one user input on the display related to the at least one control option, and transmit instructions to control the home security and/or automation system based on the at least one user input.

In one example, a computing device of the vehicle may receive the at least one user input and transmit the instructions. The computing device of the vehicle may receive geo location information from the mobile computing device and use the geo location information to determine a location of the vehicle relative to a home being monitored by the home security and/or automation system. The computing device of the vehicle may include a global positioning system operable to determine geo location information, and the computing device may use the geo location information to determine a location of the vehicle relative to a home being monitored by the home security and/or automation system. The display of the vehicle may include a touch screen, and the at least one user input may include a touch input to the touch screen. Transmitting instructions may include communicating with the home security and/or automation system via the mobile computing device. Transmitting instructions may include communicating wirelessly from a computing device of the vehicle to a control panel of the home security and/or automation system. The instructions may be further executable by the processor to automatically display the at least one control option on the display when the mobile computing device is linked with the display of the vehicle and the vehicle operation is confirmed. The instructions may be further executable by the processor to display on the vehicle display content shown on a viewable display of the mobile computing device.

A further embodiment is directed to a non-transitory computer-readable medium storing computer-executable code. The code is executable by a processor to link a user's mobile computing device to a vehicle display, confirm operation of the vehicle, display on a display of the vehicle at least one control option for a home security and/or automation system, receive at least one user input on the display related to the at least one control option, and transmit instructions to the home security and/or automation system via the user's mobile computing device to control the home security and/or automation system based on the at least one user input.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

Figure 1:
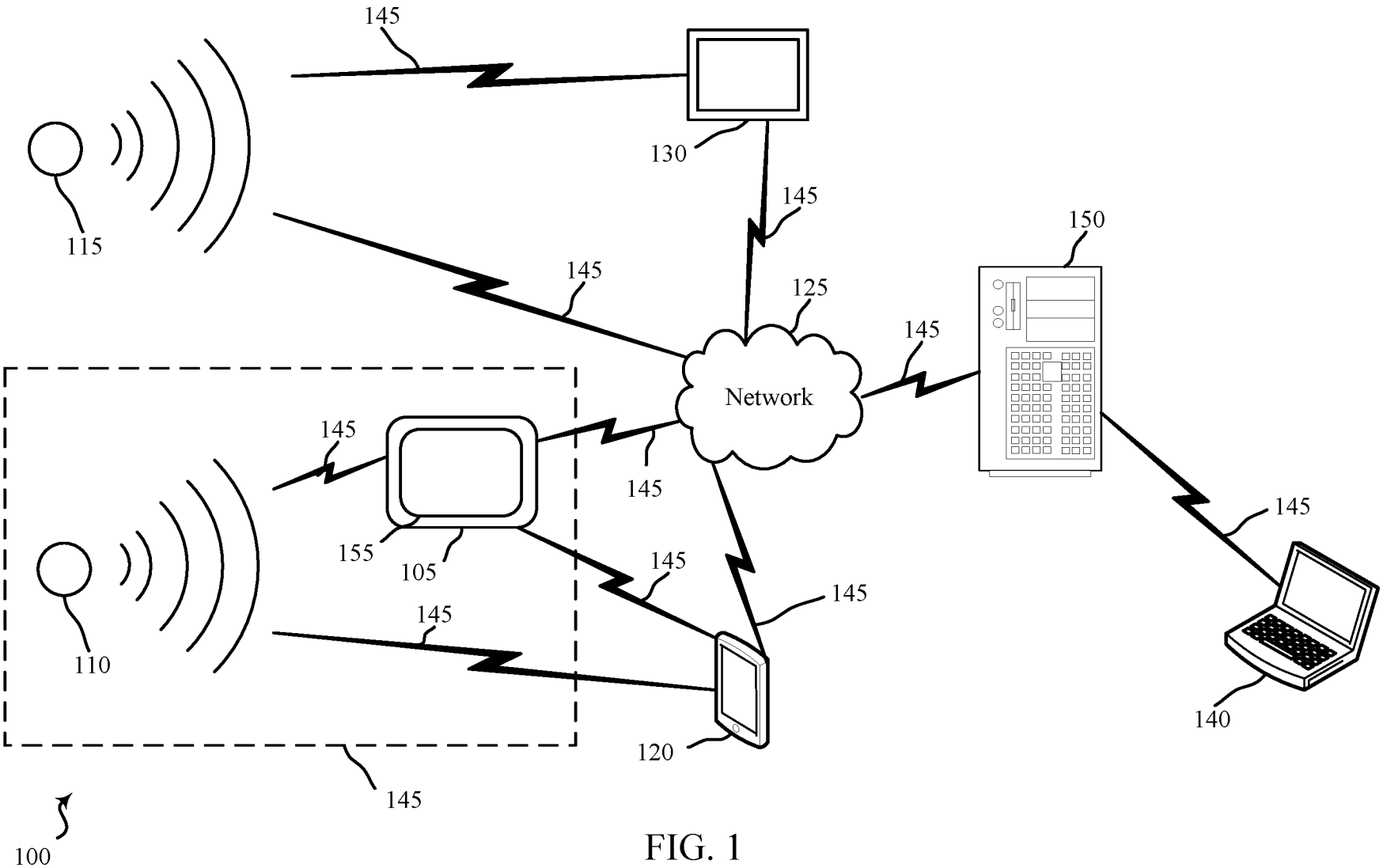
FIG. 1 shows a block diagram of an example of a vehicle integration system, in accordance with various aspects of this disclosure.

Remote control of home security and/or automation systems provide a number of advantages for users. For example, a user may be able to arm or disarm a home security system from a remote location if the user does not do so when leaving the home. In another example, a user may be able to remotely monitor a living space associated with the home via a live camera feed that is transmitted to the user's mobile computing device. Another example may include remotely operating doors (e.g., a garage door) or adjusting an HVAC setting or lighting of a property via a user's remote (e.g., mobile) computing device. Challenges exist related to accessing and manipulating a mobile computing device while the user is operating a vehicle. Such use of a mobile computing device may be illegal or, at a minimum, unsafe while the user is operating or riding in a vehicle.

The systems and methods of the present disclosure provide remote access to a home security and/or automation system using a vehicle computing system, and particularly using a display of a vehicle computing system (a "vehicle display"). A mobile computing device carried by a user may link with the vehicle computing system and display information from the mobile computing device on the vehicle display. The user may provide input related to operation of the home security and/or automation system via the vehicle display. The mobile computing system may communicate the user input (e.g., commands and/or instructions) to the home security and/or automation system to operate and/or adjust one or more functions of the home security and/or automation system.

The systems and methods disclosed herein may confirm the presence of the user within the vehicle and operation of the vehicle as part of determining whether to display command options, display information about the security and/or automation system, and/or receive user inputs at the vehicle display. In at least some embodiments, operation of the vehicle includes movement of the vehicle, an on/off state of the vehicle engine, and/or the transmission actuated into a forward/reverse gear. In some embodiments, the vehicle computing system may bypass the mobile computing device and communicate directly with the home security and/or automation system rather. In other embodiments, the information displayed on the mobile computing device is replicated on the vehicle display and the user inputs related to selected commands, etc. may be routed from the vehicle display (e.g., via the vehicle computing device), through the mobile computing device, and to the security and/or automation system.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

FIG. 1 is an example of a communications system 100 in accordance with various aspects of the disclosure. In some embodiments, the communications system 100 may include a vehicle computing device 105, at least one vehicle sensor unit 110, one or more sensor units 115, a mobile computing device 120, a network 125, a control panel 130, a remote computing device 140, and a server 150. The components of system 100 may communicate via wired or wireless communication links 145 (e.g., via network 125). The network 125 may communicate via wired or wireless communication links 145 with the control panel 130 and the remote computing device 140 via server 150. In alternate embodiments, the network 125 may be integrated with any one of the components of system 100, such that separate network components are not required. The vehicle computing device 105 may include a vehicle display 155.

The computing devices 105, 120, 140 may be custom computing entities configured to interact with sensor units 110, 115 via network 125, and in some embodiments, via server 150. In other embodiments, computing device 105, 120, 140 may be general purpose computing entities such as a personal computing device, for example, a desktop computer, a laptop computer, a netbook, a tablet personal computer (PC), a control panel, an indicator panel, a multi-site dashboard, an iPod®, an iPad®, a smart phone, a mobile phone, a personal digital assistant (PDA), a vehicle computing device, and/or any other suitable device operable to send and receive signals, store and retrieve data, and/or execute modules.

Control panel 130 may be a smart home system panel, for example, an interactive panel mounted on a wall in a user's home. Control panel 130 may be in direct communication via wired or wireless communication links 145 with the one or more sensor units 115, or may receive sensor data from the one or more sensor units 110 via computing devices 105, 120 and network 125, or may receive data via remote computing device 140 and/or server 150 via network 125.

The computing devices 105, 120 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the computing devices 105, 120 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from sensor units 110, 115.

The processor of the computing devices 105, 120 may be operable to control operation of the output of the computing devices 105, 120. The output may include, for example, a liquid crystal display (LCD) monitor, speaker, tactile output device, and/or the like. In some embodiments, the output may be an integral component of the computing devices 105, 120. Similarly stated, the output may be directly coupled to the processor. For example, the output may be the integral display of a tablet and/or smart phone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the computing devices 105, 120 to the output.

The remote computing device 140 may be a computing entity operable to enable a remote user to monitor the output of the sensor units 110, 115. The remote computing device 140 may be functionally and/or structurally similar to the computing devices 105, 120 and may be operable to receive data streams from and/or send signals to at least one of the sensor units 110, 115 via the network 125. The network 125 may be the Internet, an intranet, a personal area network, a local area network (LAN), a wide area network (WAN), a virtual network, a telecommunications network implemented as a wired network and/or wireless network, etc. The remote computing device 140 may receive and/or send signals over the network 125 via communication links 145 and server 150.

In some embodiments, the one or more sensor units 110, 115 may be sensors configured to conduct periodic or ongoing automatic measurements related to or in cooperation with a vehicle. Each sensor unit 110, 115 may be capable of sensing multiple vehicle related parameters, or alternatively, separate sensor units 110, 115 may monitor separate vehicle related parameters. For example, one sensor unit 110 may measure or determine presence of a person in a driver's seat of a vehicle, while another sensor unit 110 (or, in some embodiments, the same sensor unit 110) may detect movement of the vehicle, operation of one or more aspects of the vehicle (e.g., an on/off state of the vehicle engine), or presence of a user's mobile computing device in proximity to the vehicle (e.g., presence of a user's phone inside the vehicle). In some embodiments, one or more sensor units 115 may be located at a property where the vehicle resides and may additionally monitor alternate parameters, such as the presence of the vehicle at the property (e.g., within a garage stall) or movement of the vehicle entering into or departing from the property. Sensor units 110, 115 may monitor a variety of other parameters, such as temperature, pressure, wireless communication links, vibration, acceleration, sound, and the like. The sensor units 110, 115 may be integrated into at least one of the computing devices 105, 120.

In alternate embodiments, a user may input vehicle data directly at the computing device 105, 120 or at remote computing device 140. For example, a user may enter data into a dedicated application on his smart phone or via a display of the vehicle indicating that the user has entered a vehicle, that the vehicle is traveling, that the vehicle is traveling in a certain direction, that the user has input instructions via a display of the vehicle, and/or that the vehicle has crossed a geo boundary.

Data gathered by the one or more sensor units 110, 115 may be communicated to computing device 105, 120, which may be, in some embodiments, include at least one display (e.g., vehicle display 155). In other embodiments, computing device 120 may be a personal computer or smart phone. If computing device 120 is a smart phone, the smart phone may have a dedicated application directed to collecting vehicle related data, receiving inputs entered at display of the vehicle, and relaying or otherwise transmitting the vehicle related data and/or input entered at the display to a security and/or automation system (e.g., control panel 130). The computing device 105, 120 may process the data received from the one or more sensor units 110, 115 to be used as part of making a vehicle display available for user inputs related to control of a home security and/or automation system. In alternate embodiments, remote computing device 140 may process the data received from the one or more sensor units 110, 115, via network 125 and server 150, to facilitate such use of the vehicle display for user inputs and/or to control the home security and/or automation system. Data transmission may occur via, for example, frequencies appropriate for a personal area network (such as BLUETOOTH® or IR communications) or local or wide area network frequencies such as radio frequencies specified by the IEEE 802.15.4 standard.

In some embodiments, computing device 105, 120 may communicate with remote computing device 140 or control panel 130 via network 125 and server 150. Examples of network 125 include cloud networks, local area networks (LAN), wide area networks (WAN), virtual private networks (VPN), wireless networks (using 802.11, for example), and/or cellular networks (using 3G and/or LTE, for example), etc. In some configurations, the network 125 may include the Internet. In some embodiments, a user may access the functions of computing device 105, 120 from remote computing device 140. For example, in some embodiments, any one of computing devices 105, 120, 140 may include a mobile application that interfaces with one or more functions of the other computing devices 105, 120, 140 and/or control panel 130 of a security and/or automation system.

The server 150 may be configured to communicate with the sensor units 110, 115, the computing devices 105, 120, 140, and control panel 130. The server 150 may perform additional processing on signals received from the sensor units 110, 115 or computing devices 105, 120, or may simply forward/relay the received information to the remote computing device 140 and control panel 130.

Server 150 may be a computing device operable to receive data streams (e.g., from sensor units 110, 115 and/or computing device 105, 120 or remote computing device 140), store and/or process data, and/or transmit data and/or data summaries (e.g., to remote computing device 140). For example, server 150 may receive a stream of vehicle related data from one or more sensor units 110, 115, or a stream of command data from one or both of computing devices 105, 120. In some embodiments, server 150 may "pull" the data streams, e.g., by querying the sensor units 110, 115, the computing devices 105, 120, and/or the control panel 130. In some embodiments, the data streams may be "pushed" from the sensor units 110, 115 and/or the computing devices 105, 120 to the server 150. For example, the sensor units 110, 115 and/or the computing device 105, 120 may be configured to transmit data as it is generated by or entered into that device. In some instances, the sensor units 110, 115 and/or the computing devices 105, 120 may periodically transmit data (e.g., as a block of data or as one or more data points).

The server 150 may include a database (e.g., in memory) containing historical vehicle related and/or command data received from the sensor units 110, 115 and/or the computing devices 105, 120. Additionally, as described in further detail herein, software (e.g., stored in memory) may be executed on a processor of the server 150. Such software (executed on the processor) may be operable to cause the server 150 to monitor, process, summarize, present, and/or send a signal associated with resource usage data.

Figure 2:
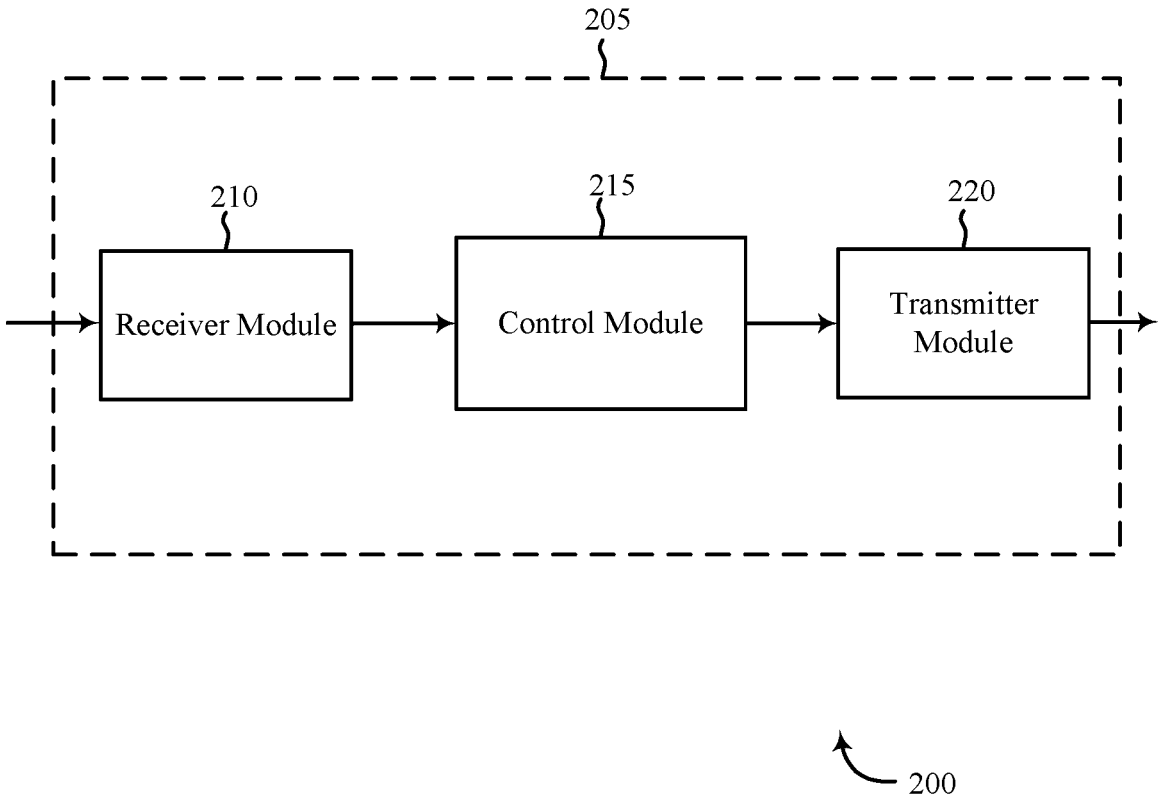
FIG. 2 shows a block diagram of a device relating to a vehicle integration system, in accordance with various aspects of this disclosure.

FIG. 2 shows a block diagram 200 of a computing device 205 for use in electronic communication, in accordance with various aspects of this disclosure. The computing device 205 may be an example of one or more aspects of a vehicle computing device 105, mobile computing device 120, and/or remote computing device 140 described with reference to FIG. 1. The computing device 205 may include a receiver module 210, a control module 215, and/or a transmitter module 220. The computing device 205 may also be or include a processor. Each of these modules may be in communication with each other—directly and/or indirectly.

The components of the computing device 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). The receiver module 210 may be configured to receive data from one or more sensor units 110, 115. The receiver module 210 may be configured to receive user input data from, for example, a user input to a vehicle display screen. The user input data may be in the form of a command and may be referred to as command data. Information may be passed on to the control module 215, and to other components of the computing device 205.

The control module 215 may operate at least in part to provide functionality of device 205 as part of integrating a vehicle, vehicle computing device, and/or vehicle display with a security and/or automation system. The security and/or automation system may be associated with a home, commercial building, or other physical property. Control module 215, in association with device 205, may facilitate control of certain aspects of the security and/or automation system using the integrated vehicle, vehicle computing system, and/or vehicle display.

In one example, device 205 is a mobile computing device carried by a user. A user may enter a vehicle while carrying device 205. Device 205 may be used as part of confirming that the user is within the vehicle. Device 205 may also be used at least in part to determine whether the vehicle is moving, a direction of travel of the vehicle, a relative position of the vehicle to a property being monitored by the security and/or automation system, delivery of commands from the vehicle to the security and/or automation system, and the like.

In the case of device 205 being a mobile computing device carried by a user (e.g., mobile computing device 120), receiver module 210 may receive data from a number of sources. In one example, receiver module 210 receives data transmitted from a vehicle computing system, sensor units, and/or vehicle display. The received data may include, for example, confirmation of a link between device 205 and the vehicle computing device and/or vehicle display, commands entered at the vehicle display, geo location information determined by the vehicle computing system or other geo location device associated with the vehicle, and the like. Other data that may be received by receiver module 210 includes, for example, information associated with operation of the vehicle itself. For example, the receiver module 210 may receive operation data such as, for example, data related to an on/off state of the vehicle, data related to a state of the vehicle transmission (e.g., in park or in a forward or reverse gear), a movement speed of the vehicle, a direction of travel of the vehicle, etc. Receiver module 210 may also receive information about the occupants of the vehicle based on, for example, an identifier such as a mobile computing device carried by a user, pressure sensors that determine users based on user weight, motions sensors, and the like.

Control module 215 may process and/or coordinate the data received via receiver module 210. In one example, control module 215 confirms that the user is within the vehicle and confirms movement of the vehicle prior to transmitting command options or other information to the vehicle display where the command options and other information may be viewed and/or selected by a user. In other examples, control module 215 operates to confirm a geo location of the vehicle relative to, for example, the property being monitored by a security end or automation system. The geo location information may be used in addition to or in some combination with user location within the vehicle and operation (e.g., movement) of the vehicle.

Control module 215 may act as a relay that relays command data received from the vehicle computing system and/or vehicle display. A control module 215 may relay the command data to the security and/or automation system via transmitter module 220. The command data may be delivered directly to, for example, a control panel of the security and/or automation system. Alternatively, the command data may be transmitted to the control panel via the back end server of the security and/or automation system (e.g., back end server 150).

In another embodiment, device 205 represents a vehicle computing device (e.g., vehicle computing device 105 described with reference to FIG. 1). Device 205 in this scenario may receive different types of data as compared to when device 205 is a mobile computing device as described above. Device 205 may receive data from a variety of sources including, for example, a mobile computing device carried by a user and located within a vehicle. The data received from the mobile computing device may include, for example, command options on a display of the vehicle. In at least some examples, the vehicle display is integral with the vehicle computing device. A vehicle computing device may display the command options, wherein the command options are associated with a security and/or automations system. The displayed command options may mirror or duplicate the command options displayed on the mobile computing device itself. Generally, any information available and/or visible on the mobile computing device may be made available and/or visible on the vehicle display.

Receiver module 210 may receive other types of data such as, for example, data related to operation of the vehicle (e.g., an on/off state or a transmission setting such as a forward or reverse gear), or data related to the occupants of the vehicle. Receiver module 210 may receive data directly from the security and/or automation system via, for example, a back end server (e.g., back end server 150 described with reference to FIG. 1) or a control panel of the security and/or automation system (e.g., control panel 130). In at least some examples, device 205 may operate a mobile computing application for use in remote control of a security and/or automation system. Functionality of the application may be dependent on certain criteria being met such as, for example, confirmation that a user is within the vehicle, operation of the vehicle (e.g., the vehicle is moving), and/or geo location information regarding the location of the vehicle relative to a security and/or automation system. The user's mobile computing device in this case may be used to confirm location of the user within the vehicle. The mobile computing application operating on the user's mobile computing device may be used as a backup to the mobile computing application being operated on the vehicle computing device 205. In other arrangements, the user's mobile computing device may be used to provide other data such as, for example, geo location information.

In the case where device 205 is the vehicle computing device, control module 215 may operate to process the data received by receiver module 210 and facilitate transmission of data, commands, instructions, and the like to other devices, systems, etc. via transmitter module 220. For example, control module 215 may transmit data to a user's mobile computing device, and the user's mobile computing device is used to transmit or relay the data to a security and/or automation system (e.g., back end server 150 and/or control panel 130).

The transmitter module 220 may transmit the one or more signals received from other components of the computing device 205. The transmitter module 220 may transmit sensor data, command data, and other information related to a vehicle, its operation, and users of the vehicle and their associated mobile computing devices. In some examples, the transmitter module 220 may be collocated with the receiver module 210 in a transceiver module.

Figure 3:
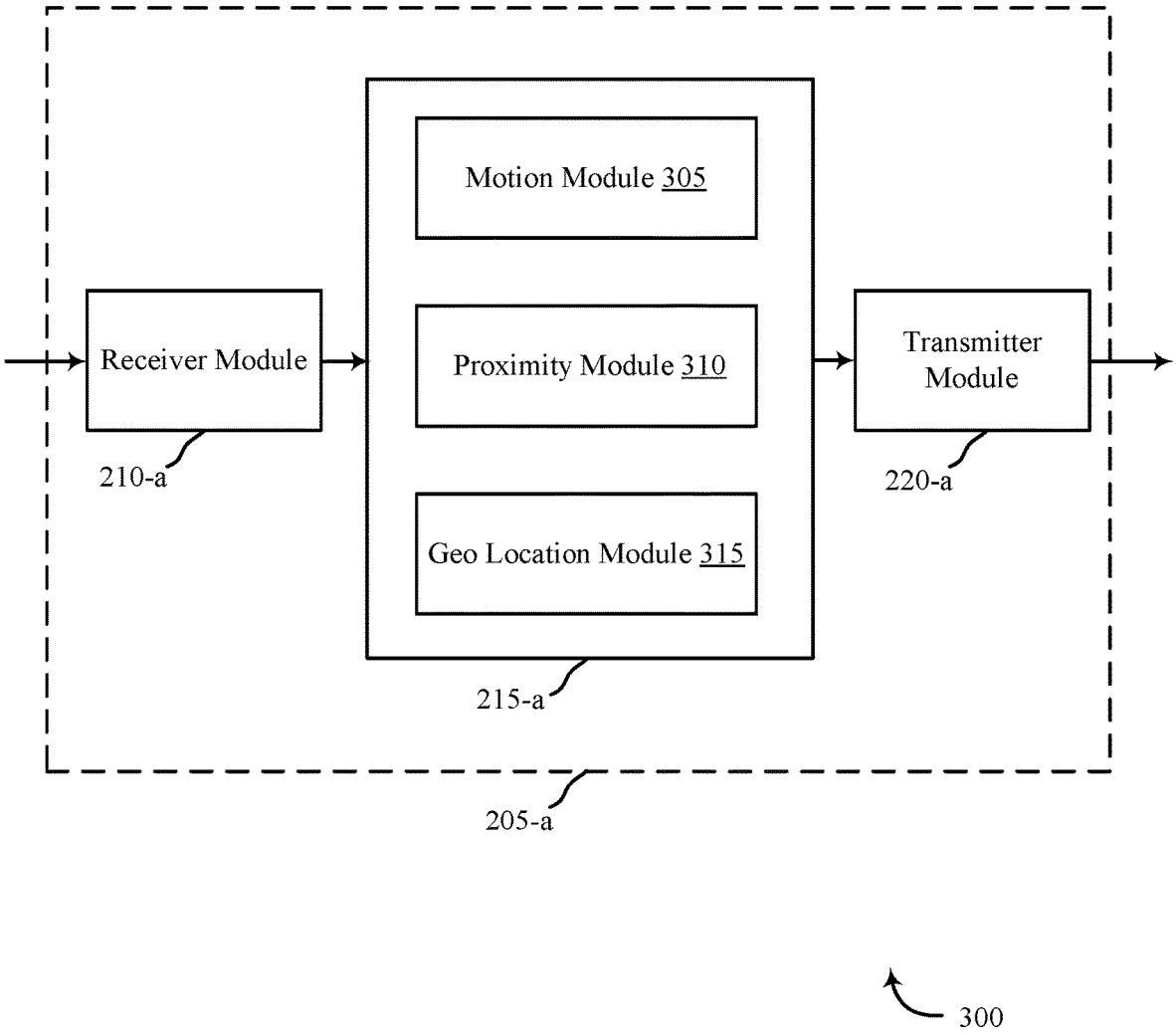
FIG. 3 shows a block diagram of a device relating to a vehicle integration system, in accordance with various aspects of this disclosure.

FIG. 3 shows a block diagram 300 of a computing device 205-*a* for use in wireless communication, in accordance with various examples. The computing device 205-*a* may be an example of one or more aspects of computing devices 105, 120 described with reference to FIG. 1. It may also be an example of a computing device 205 described with reference to FIG. 2. The computing device 205-*a* may include a receiver module 210-*a*, a control module 215-*a*, and/or a transmitter module 220-*a*, which may be examples of the corresponding modules of computing device 205. The computing device 205-*a* may also include a processor. Each of these components may be in communication with each other. The control module 215-*a* may include a motion module 305, a proximity module 310, and a geo location module 315. The motion module 305 may also be referred to as a vehicle operation module. The receiver module 210-*a* and the transmitter module 220-*a* may perform the functions of the receiver module 210 and the transmitter module 220 of FIG. 2, respectively.

The motion module 305 may operate to detect motion of the vehicle. The motion of the vehicle may be relevant to determining whether or not to use the vehicle display for purposes of receiving user selected commands for control of a security and/or automation system. Motion module 305 may receive motion data from various sources including, for example, a computing system of the vehicle, a mobile computing device located in the vehicle, one or more sensor units, or a manual entry inputted by a user to a mobile computing device and/or vehicle computing device.

Motion module 305 may also operate to determine a direction of motion of the vehicle (e.g., forward or reverse direction), a speed of motion, acceleration and/or deceleration of the vehicle, and other parameters related to motion of the vehicle. Motion module 305 may determine motion or other operations of the vehicle based on various vehicle related data. For example, motion module 305 may detect an on/off state of the vehicle, a state of the vehicle transmission (e.g., drive, park or reverse), an RPM of the vehicle engine, and the like. In at least some embodiments, motion module 305 may detect operation of the vehicle as a qualifying parameter for determining whether to present a command option at the vehicle display.

The proximity module 310 may operate to determine location of a user and/or a user's mobile computing device within a vehicle. Proximity module 310 may receive proximity related data from various sources including, for example, various sensors within the vehicle (e.g., a pressure sensor positioned in a seat of the vehicle, a motion sensor within the vehicle, a touch sensor, or the like), the vehicle computing device which indicates operation of some feature or functionality of the vehicle, or data from the mobile computing device, such as data that indicates a communication link established between the mobile computing device and the vehicle computing device. Proximity module 310 may coordinate data from various sources to determine and/or confirm that the user is within a vehicle. In one example, proximity module 310 may receive data from a security and/or automation system indicating that a user has left a home or their property (e.g., based on operation of an exterior door, a garage door, a motion sensor indicating departure through a particular living space or opening, and the like) along with data related to the vehicle such as an indicator that the vehicle door has been opened and/or closed, the vehicle engine has turned on or off, and the like.

In at least some embodiments, control module 215-*a* may operate based on operation of the motion module 305 and proximity module 310 related to presence of the user and the vehicle and operation and/or movement of the vehicle as prerequisites to allowing a user to provide commands via the vehicle display in association with control of a security and/or automation system. In other embodiments, control module 215-*a* may also receive inputs from geo location module 315 as part of determining when to allow the user to enter commands via the vehicle display. The geo location module 315 may operate to determine a location of the vehicle itself or a mobile computing device of the user that is located within the vehicle. The geo location information may be relevant as it provides a determination of the location of the vehicle relative to a property monitored by the security and/or automation system. The relative location of the vehicle to the monitored property may help determine if the vehicle has crossed outside of a geo boundary, which may indicate that the vehicle is departing from the monitored property, or that the vehicle has crossed into a geo boundary indicating that the vehicle is approaching the monitored property. The geo boundary may correlate with a zone within which the mobile computing application carried by the mobile computing device and/or vehicle computing device is able to provide remote control of the security and/or automation system using a particular communication medium. In other examples, the geo location information of the vehicle is used as a further criteria to ensure that the user is in a particular geographic location relative to the property before permitting entry of commands via the vehicle display.

The concept of permitting or not permitting user inputs to a vehicle display in association with providing commands or instructions for operation of a security and/or automation system of a home, business or other property may include various options associated with a vehicle display. For example, permitting such user inputs may include displaying or not displaying command options on the vehicle display. In another example, permitting or not permitting may relate to activating certain features or functionality of the vehicle display in association with command options that have already been presented on the vehicle display. For example, a vehicle display may include a touch screen with various portions of the touch screen that are activated or deactivated for purposes of accepting user inputs to the touch screen to select a displayed command option. Whether or not the portions of the touch screen are activated or deactivated may be based on operation of control module 215-*a* confirming, for example, that the user is within the vehicle, that the vehicle is operating (e.g., moving), and/or that the vehicle has crossed or is within a certain geo boundary as determined by the motion module 305, proximity module 310, and/or geo location module 315.

Figure 4:
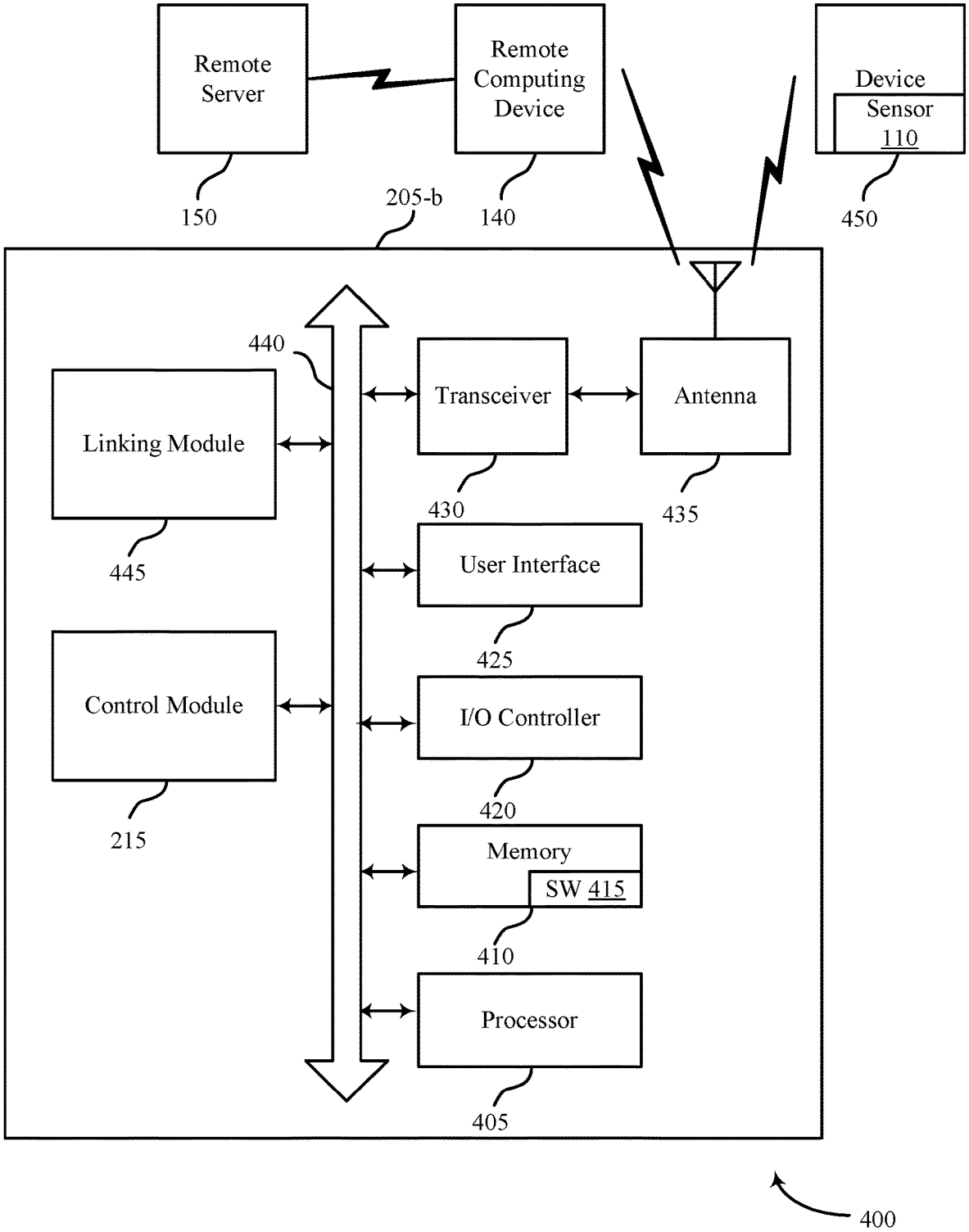
FIG. 4 shows a block diagram relating to a vehicle integration system, in accordance with various aspects of this disclosure.

FIG. 4 shows a system 400 for use in a system that integrates a vehicle computing system and/or vehicle display with features of a home security and/or automation system, in accordance with various examples. System 400 may include a computing device 205-*b*, which may be an example of the computing devices 105, 120 of FIG. 1.

Computing device 205-*b* may include a linking module 445, which may operate independently or may be part of the control module 215 described with reference to FIGS. 2 and 3. Computing device 205-*b* may also include control module 215, which may be an example of control module 215 described with reference to FIGS. 2 and 3.

Computing device 205-*b* may also include components for bi-directional voice and data communications including components for transmitting communications and components for receiving communications. For example, computing device 205-*b* may communicate bi-directionally with a device 450, which may include one or more sensor units 110, remote computing device 140, and back end server 150, which may be examples of the components described with reference to FIG. 1. This bi-directional communication may be direct (e.g., computing device 205-*b* communicating directly with remote computing device 140) or indirect (e.g., computing device 205-*b* communicating indirectly with back end server 150 through remote computing device 140).

The computing device 205-*b* may include a linking module 445. Linking module 445 may operate alone or in combination with control module 215. In at least some examples, linking module 445 may operate in place of control module 215 as part of operating computing device described with reference to FIGS. 2 and 3. Linking module 445 may operate to determine a communication link between a mobile computing device and a vehicle computing device. The linking may occur when the mobile computing device is within a certain distance of the vehicle computing device. In at least some embodiments, the linking may occur only if the mobile computing device is located within an interior of the vehicle. The linking may occur wirelessly or through a wired connection. In at least some examples, the linking may require a user input such as a confirmation that the user acknowledges or permits the linking to occur based on an input to the mobile computing device or the vehicle computer (e.g., via the vehicle display).

Confirmation of the link between the user's mobile computing device and the vehicle computing device via linking module 445 may alone meet established requirements in order for the vehicle display to be used to receive user inputs for commands and/or instructions to control the security and/or automation system, or receive other information about the security and/or automation system for viewing on the vehicle display. The linking detected by linking module 445 may integrate the vehicle computing device and/or vehicle display as a component or extension of the security and/or automation system.

The device 205-*b* may in one embodiment represent the user's mobile computing device and the device 450 may represent the vehicle computing device. In other examples, device 205-*b* may represent the vehicle computing device and the device 450 may represent the user's mobile computing device. In this arrangement, the linking module 445 and/or control module 215 may operate at least in part on either the user's mobile computing device or the vehicle computing device depending on how the system 400 is set up for operation.

Computing device 205-*b* may also include a processor module 405, a memory 410 (including software/firmware code (SW) 415), an input/output controller module 420, a user interface module 425, a transceiver module 430, and one or more antennas 435 each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of device 450 (which may include one or more of computing devices 105, 120), remote computing device 140, and/or back end server 150. The transceiver module 430 may include a modem to modulate the packets and provide the modulated packets to the one or more antennas 435 for transmission, and to demodulate packets received from the one or more antenna 435. While a computing device (e.g., 205-*b*) may include a single antenna 435, the computing device may also have multiple antennas 435 capable of concurrently transmitting or receiving multiple wired and/or wireless transmissions. In some embodiments, one element of computing device 205-*b* (e.g., one or more antennas 435, transceiver module 430, etc.) may provide a direct connection to back end server 150 via a direct network link to the Internet via a POP (point of presence). In some embodiments, one element of computing device 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z-WAVE®, cellular network (using 3G and/or LTE, for example), and/or other signals. The one or more antennas 435 and/or transceiver module 430 may include or be related to, but are not limited to, WWAN (GSM, CDMA, and WCDMA), WLAN (including BLUETOOTH® and Wi-Fi), WMAN (WiMAX), antennas for mobile communications, antennas for Wireless Personal Area Network (WPAN) applications (including RFID and UWB). In some embodiments, each antenna 435 may receive signals or information specific and/or exclusive to itself. In other embodiments, each antenna 435 may receive signals or information not specific or exclusive to itself.

In some embodiments, one or more sensor units 110 (e.g., motion, proximity, smoke, light, glass break, door, window, carbon monoxide, and/or another sensor) may connect to some element of system 400 via a network using one or more wired and/or wireless connections. As noted above, sensor units 110 (which may also include sensor units 115 described with reference to FIG. 1) may be part of or cooperate with device 450.

In some embodiments, the user interface module 425 may include an audio device, such as an external speaker system, an external display device such as a display screen, and/or an input device (e.g., remote control device interfaced with the user interface module 425 directly and/or through I/O controller module 420).

One or more buses 440 may allow data communication between one or more elements of computing device 205-*b* (e.g., processor module 405, memory 410, I/O controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., link a mobile computing device located within a vehicle to a display of the vehicle, relay user selected commands to a security and/or automation system, detect motion of the vehicle, coordinate proximity data, vehicle motion data and geo location data as part of determining whether to display home security and/or automation system commands on the vehicle display, etc.). Alternatively, the computer-readable, computer-executable software/firmware code 415 may not be directly executable by the processor module 405, but may be configured to cause a computer (e.g., when compiled and executed) to perform functions described herein. The processor module 405 may include an intelligent hardware device, e.g., a central processing unit (CPU), a microcontroller, an application-specific integrated circuit (ASIC), etc.

In some embodiments, the memory 410 can contain, among other things, the Basic Input-Output system (BIOS) which may control basic hardware and/or software operation such as the interaction with peripheral components or devices. For example, the linking module 445 to implement the present systems and methods may be stored within the system memory 410. Applications resident with system 400 are generally stored on and accessed via a non-transitory computer readable medium, such as a hard disk drive or other storage medium. Additionally, applications can be in the form of electronic signals modulated in accordance with the application and data communication technology when accessed via a network interface (e.g., transceiver module 430, one or more antennas 435, etc.).

Many other devices and/or subsystems may be connected to one or may be included as one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems can be interconnected in different ways from that shown in FIG. 4. In some embodiments, an aspect of some operation of a system, such as that shown in FIG. 4, may be readily known in the art and are not discussed in detail in this application. Code to implement the present disclosure can be stored in a non-transitory computer-readable medium such as one or more of system memory 410 or other memory. The operating system provided on I/O controller module 420 may be iOS®, ANDROID®, MS-DOS®, MS-WINDOWS®, OS/2®, UNIX®, LINUX®, or another known operating system.

The transceiver module 430 may include a modem configured to modulate the packets and provide the modulated packets to the antennas 435 for transmission and/or to demodulate packets received from the antennas 435. While the computing device (e.g., 205-*b*) may include a single antenna 435, the computing device (e.g., 205-*b*) may have multiple antennas 435 capable of concurrently transmitting and/or receiving multiple wireless transmissions.

The computing device 205-*b* may include a control module 215-*b*, which may perform the functions described above for the control modules 215 of computing device 205 of FIGS. 2 and 3. The computing device 205-*b* may also include other modules that provide additional functionality related to integration of a vehicle, vehicle computing system, and/or vehicle display with a home security and/or automation system and/or control of such as system.

Figure 5A:
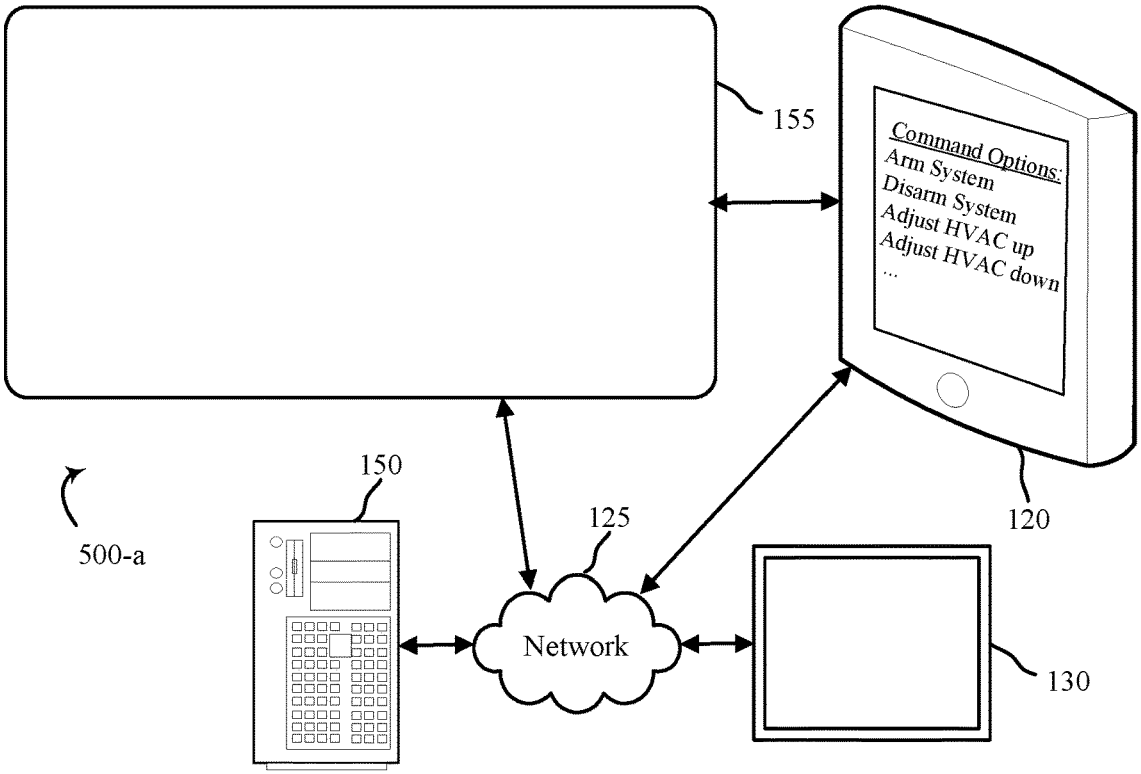
FIG. 5A shows a block diagram relating to a vehicle integration system at a first time, in accordance with various aspect of this disclosure.
Figure 5B:
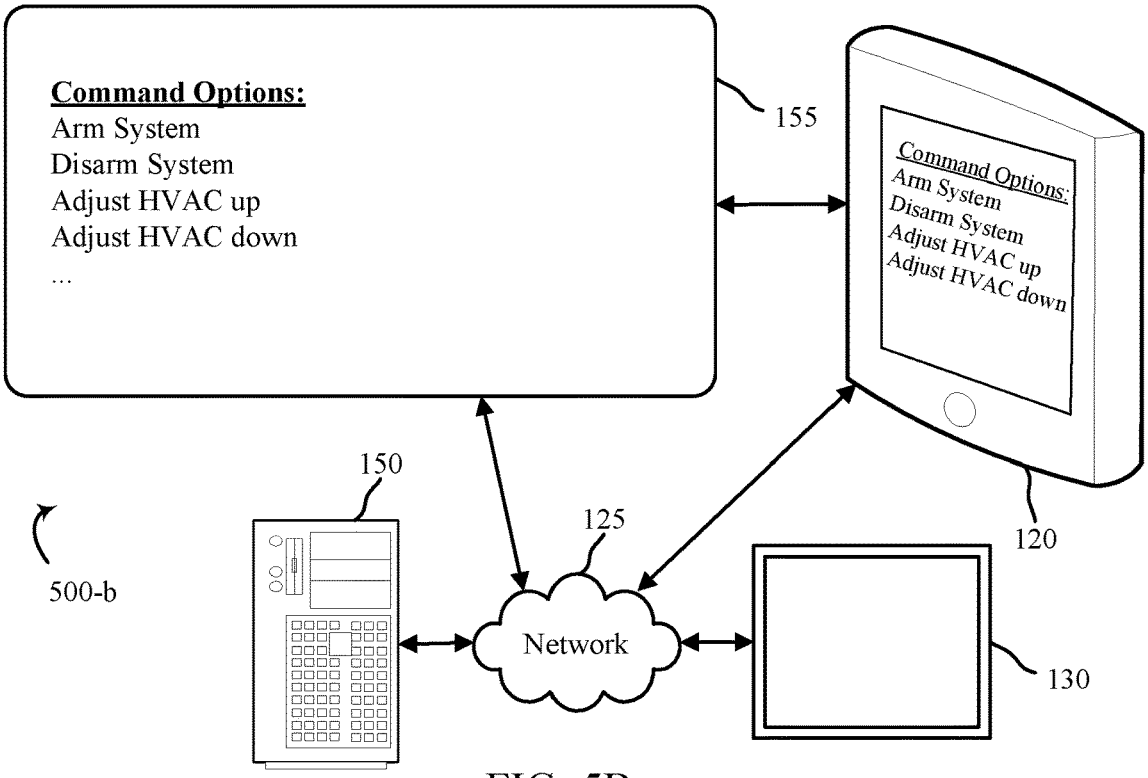
FIG. 5B shows a block diagram relating to a vehicle integration system at a second time, in accordance with various aspect of this disclosure.

FIGS. 5A and 5B illustrate a system 500-*a* and 500-*b*, respectively, which may include components of the system 100 described above with reference to FIG. 1. For example, systems 500-*a* and 500-*b* may include a mobile computing device 120, a network 125, a control panel 130 of a security and/or automation system, a back end server 150, and a vehicle display 155. The vehicle display 155 may be a part of or cooperate with a vehicle computing device (e.g., vehicle computing device 105 described above with reference to FIGS. 1-4).

FIG. 5A may represent operation of system 500-*a* at a time $T_1$. At time $T_1$ a plurality of command options may be available on mobile computing device 120. The command options may be displayed on a display on the mobile computing device 120. FIG. 5A shows a plurality of command options visible on mobile computing device 120. In at least some scenarios, the mobile computing device 120 is concealed while the user is located within and operating a vehicle. For example, a mobile computing device 120 may be in the form of a smart phone that is carried in the user's pocket, or a tablet or laptop computer that is held in a bag or briefcase of the user and positioned within the interior of the vehicle. The time $T_1$ may represent any time up to a point at which the system 500-*a* enables user input on vehicle display 155 to select among command options for control of a security and/or automation system. At time $T_1$, the command options may be concealed from view on vehicle display 155. Alternatively, the command options may be displayed on vehicle display 155 but may be inactive or in some way presented such that a user is unable to select among the command options. FIG. 5A shows vehicle display 155 as being blank, which may represent a lack of access to or permission to select among possible command options for controlling a security and/or automation system. A device operating a control module (e.g., device 205 with control module 215 described above with reference to FIGS. 2-4) may receive various data and determine whether to make the command options available on the vehicle display 155 for selection by a user of the vehicle.

FIG. 5B illustrates a time $T_2$ in which the control module has determined that it is appropriate to display and/or make available command options for selection by a user via vehicle display 155. FIG. 5B shows the command options available on mobile computing device 120 also available on vehicle display 155. In at least some examples, all information visible or otherwise displayed on mobile computing device 120 may also be displayed and/or visible on vehicle display 155. In other examples, some or all of the command options for control of the security and/or automation system, whether or not displayed or accessible via mobile computing device 120, may be made available via vehicle display 155.

A user may select one or more of the command options visible on vehicle display 155 shown in FIG. 5B. The selected commands may be routed to the security and/or automation system via back end server 150 to control panel 130, directly to control panel 130 and bypassing back end server 150, routed through mobile computing device 120 directly to control panel 130 or via back end server 150 to control panel 130, or through a vehicle computing device to the security and/or automation system via at least one of mobile computing device 120, back end server 150 and control panel 130.

The command options displayed on vehicle display 155 may be presented in a variety of ways. For example, the command options may each have separate active areas on a touch screen of vehicle display 155. In another example, the command options are accessible via drop down menus, manually actuated buttons, keypads, and the like that are associated with vehicle display 155.

The systems 500-*a* and 500-*b* shown in FIGS. 5A and 5B may include a mobile computing device 120. In at least some examples, the mobile computing device 120 may be replaced with a vehicle computing device (e.g., computing device 105 described with reference to FIG. 1 or one of devices 205 described with reference to FIGS. 2-4). The vehicle computing device and mobile computing device of the various systems disclosed herein may operate independently or in cooperation with each other to operate a control module and provide a determination as to when and how a vehicle display 155 may be used to present command options to a user for remote control of a security and/or automation system. Generally, the vehicle computing device and mobile computing device may operate, alone or combination, to integrate a vehicle display 155 as part of a remote control system for operating one or more aspects of a security and/or automation system for a property such as a home or business.

Figure 6:
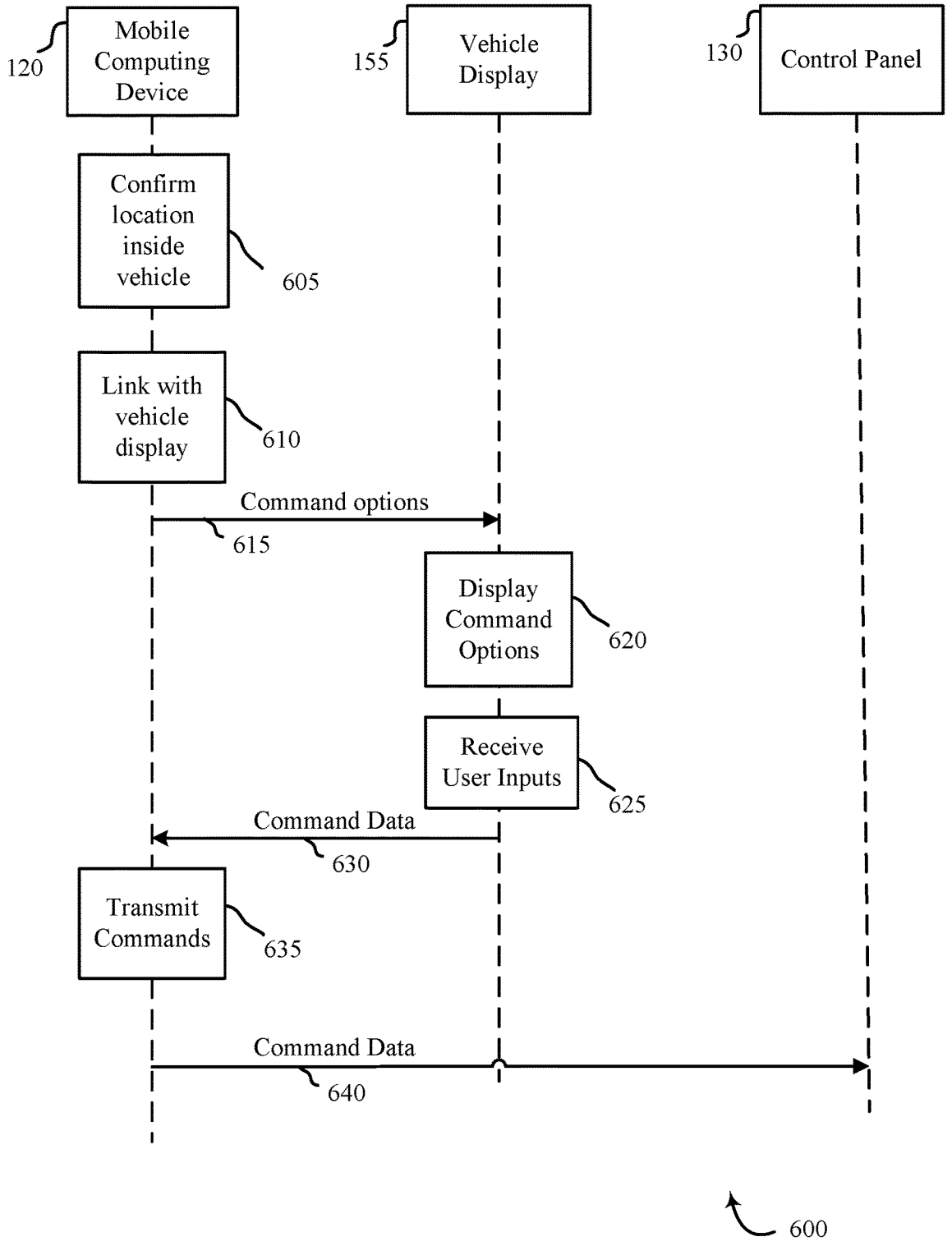
FIG. 6 shows a block diagram of a system relating to a vehicle integration system, in accordance with various aspects of this disclosure

FIG. 6 illustrates a system 600 having components of the systems described herein with references to at least FIG. 1. For example, system 600 includes a mobile computing device 120, a vehicle display 155 and a control panel 130, which may be examples of the mobile computing device 120, vehicle display 155, and control panel 130 described above with reference to at least FIG. 1. System 600 illustrates possible functionality and timing of functions between the mobile computing device 120, vehicle display 155, and control panel 130.

Mobile computing device 120 is shown in FIG. 6 first confirming a location inside a vehicle at block 605. Confirming the location may include confirmation a location of a user of the mobile computing device 120 and/or the location of the mobile computing device 120 itself. Mobile computing device 120 may confirm the location inside the vehicle by identifying a feature within the vehicle interior, connecting with a feature of the vehicle (e.g., a vehicle computing device), or by receiving a manual input by a user that the mobile computing device 120 is inside the vehicle.

A block 610 includes linking the mobile computing device 120 with a vehicle display. The linking may occur via a vehicle computing device. The linking may occur after the mobile computing device 120 confirms location inside the vehicle at block 605. Once the mobile computing device 120 is linked with the vehicle display, one or more command options 615 may be transferred to the vehicle display 155. The command options 615 may include command options that are displayed on the mobile computing device 120. The command options 615 may be made available via a mobile computing application operated by mobile computing device 120.

Vehicle display 155 may display the command options at block 620. The displayed command options may include all or part of the command options available from the mobile computing device 120. The displayed command options 160 may be displayed for selection by a user. The vehicle display 155 may include, for example, a touch screen with active areas corresponding to one or more of the displayed command options. The user may touch the touch screen to select among the command options. In other embodiments, as described above, the vehicle display may include other types of actuation features such as, for example, a keyboard, manual buttons, drop down menus, and the like to facilitate selection of one or more of the command options. Vehicle display 155 may also receive user inputs at block 625. The user inputs may correspond with selected commands. The selected commands may be provided as command data 630 that is transferred back to the mobile computing device 120.

The mobile computing device 120 may transmit commands at block 635 as command data 640 to control panel 130. The mobile computing device 120 may act as a relay that transmits the command data 640 to the control panel 130 or other feature, component or device associated with a security and/or automation system. In other examples, the command data 640 may be transferred or relayed to a back end server (e.g., back end server 150 described with reference to FIG. 1), a remote computing device (e.g., remote computing device 140 described with reference to FIG. 1), or the like. The command data 640 may be transferred via a network (e.g., network 125) from the mobile computing device 120, which may be located inside the vehicle according to block 605 to the security and/or automation system (e.g., control panel 130).

Figure 7:
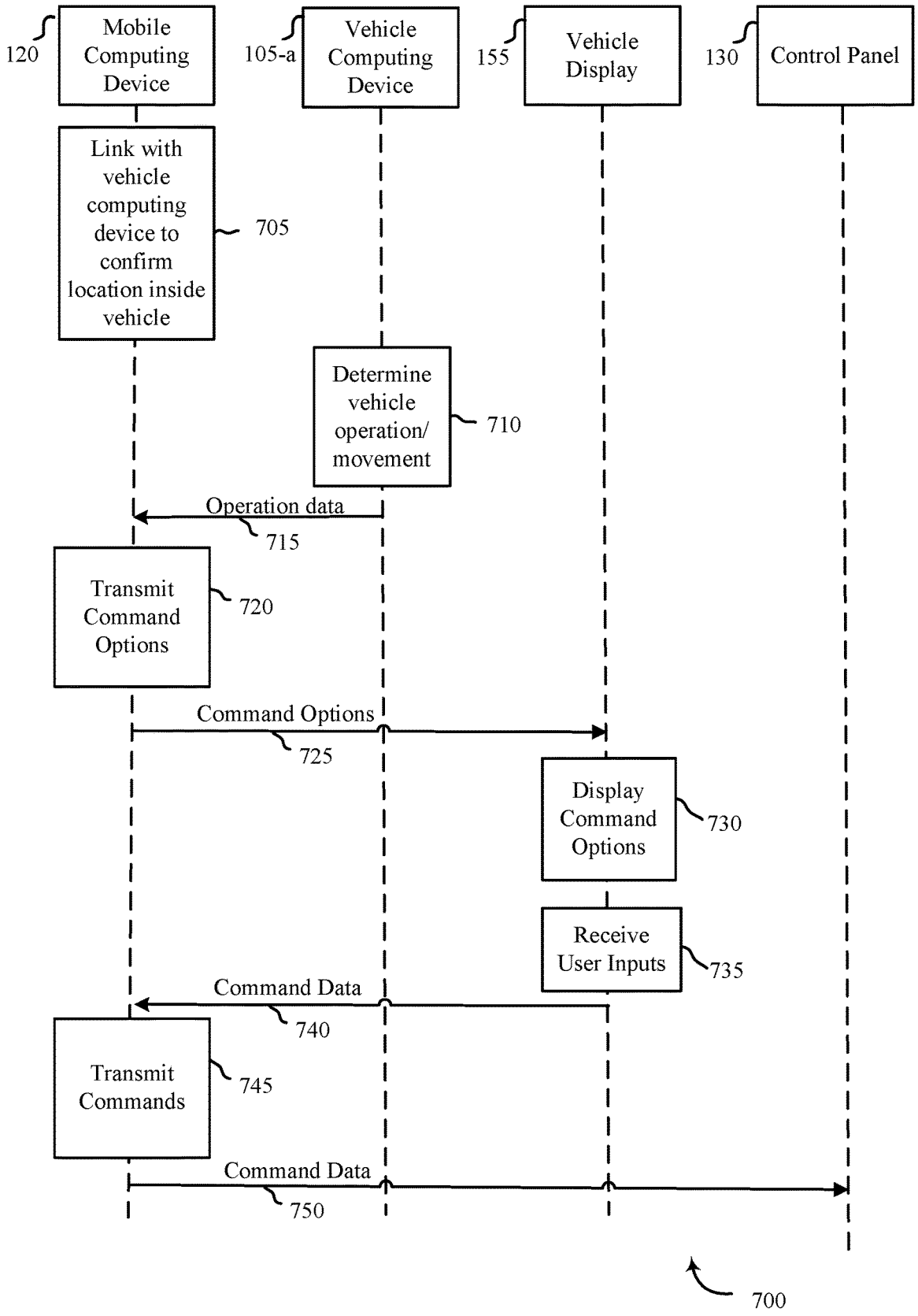
FIG. 7 shows a block diagram of a system relating to a vehicle integration system, in accordance with various aspects of this disclosure.

FIG. 7 illustrates another system 700 that includes components described with reference to at least FIG. 1. For example, a system 700 includes a mobile computing device 120, a vehicle computing device 105-*a*, a vehicle display 155, and a control panel 130. The system 700 may operate to link the mobile computing device 120 with the vehicle computing device 105-*a* to confirm location of the mobile computing device 120 within a vehicle at block 705. Confirming location of the mobile computing device 120 within a vehicle may confirm that the user is also within the vehicle. The vehicle computing device 105-*a* may determine operation and/or movement of the vehicle at block 710. The vehicle computing device 105-*a* may operate in conjunction with the mobile computing device 120 to determine operation and/or movement of the vehicle. The vehicle computing device 105-*a* may transmit operation data associated with operation and/or movement of the vehicle at step 715. The mobile computing device 120 may receive the operation data at 715 and transmit command options at block 720 to the vehicle display 155. The command options 725 may be displayed at block 730 on the vehicle display 155. The vehicle display 155 may receive user inputs at block 735. The vehicle display 155 and/or the vehicle computing device 105-*a* may then transmit command data 740 back to the mobile computing device 120. At block 745, the mobile computing device 120 may transmit command data 750 to the control panel 130 or other feature or component of a security and/or automation system. In other examples, as described above, the command data 750 may be transferred from the mobile computing device 120 to a back end server (e.g., back end server 150), a remote computing device (e.g., remote computing device 140), or other feature or aspect of the security and/or automation system.

Figure 8:
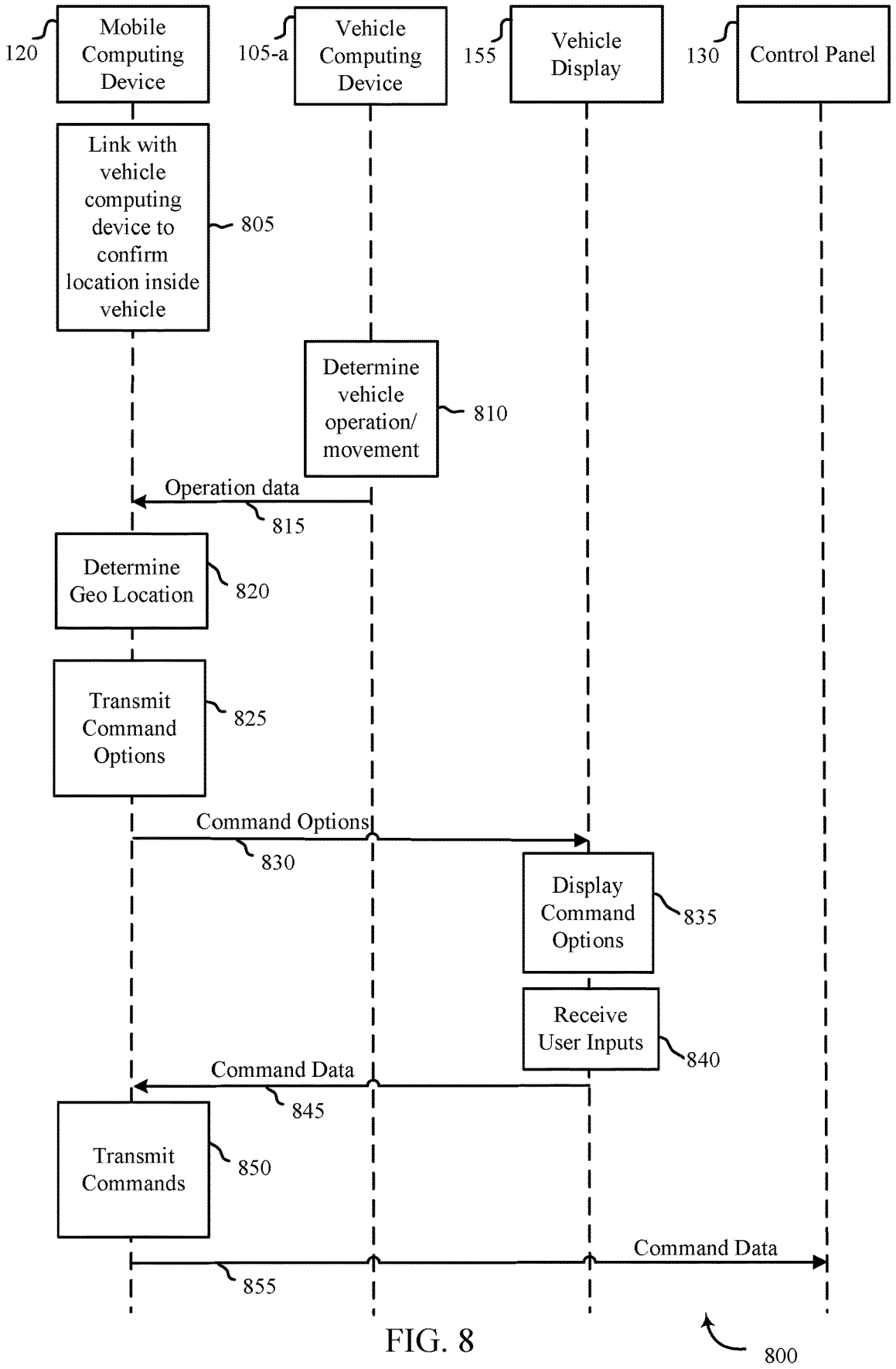
FIG. 8 shows a block diagram of a system relating to a vehicle integration system, in accordance with various aspects of this disclosure

FIG. 8 shows a system 800 that includes at least some of the same or similar components as described above with reference to FIGS. 1, 6 and 7. System 800 includes a mobile computing device 120, a vehicle computing device 105-*a*, a vehicle display 155, and a control panel 130.

At block 805, mobile computing device 120 includes linking the mobile computing device 120 with vehicle computing device 105-*a* to confirm location of the mobile computing device and/or user within the vehicle. Block 810 includes determining vehicle operation and/or movement with vehicle computing device 105-*a*. Vehicle computing device 105-*a* may cooperate with mobile computing device 120 as part of determining operation and/or movement of the vehicle. Vehicle computing device 105-*a* may transfer operational data 815 associated with the operation and/or movement of the vehicle back to the mobile computing device 120. At block 820, mobile computing device 120 determines a geo location of the vehicle and/or mobile computing device 120. The geo location may be determined relative to a property being monitored by a security and/or automation system such as a home, place of business, or other property.

At block 825, mobile computing device 120 transmits command options 830 to vehicle display 155. The command options may be routed via vehicle computing device 105-*a* as part of the being displayed on the vehicle display 155. At block 835, vehicle display 155 displays the command options. User inputs are received at block 840 at the vehicle display 155. The vehicle display 155 may transmit command data 845 directly or via vehicle computing device 105 back to mobile computing device 120. At block 850, mobile computing device 120 transmits command data 855 to the control panel 130 or other feature or component of a security and/or automation system.

System 800 utilizes proximity data (e.g., location within a vehicle), vehicle operation and/or movement, and geo location as part of determining when to make command options available at the vehicle display 155. In other embodiments, such as those disclosed with reference to FIGS. 6 and 7, the command options are provided to the vehicle display prior to or independent of determining geo location. Other embodiments are possible in which only one or two of the proximity, vehicle operation and/or movement, and geo location information is needed prior to making the command options available at the vehicle display.

Figure 9:
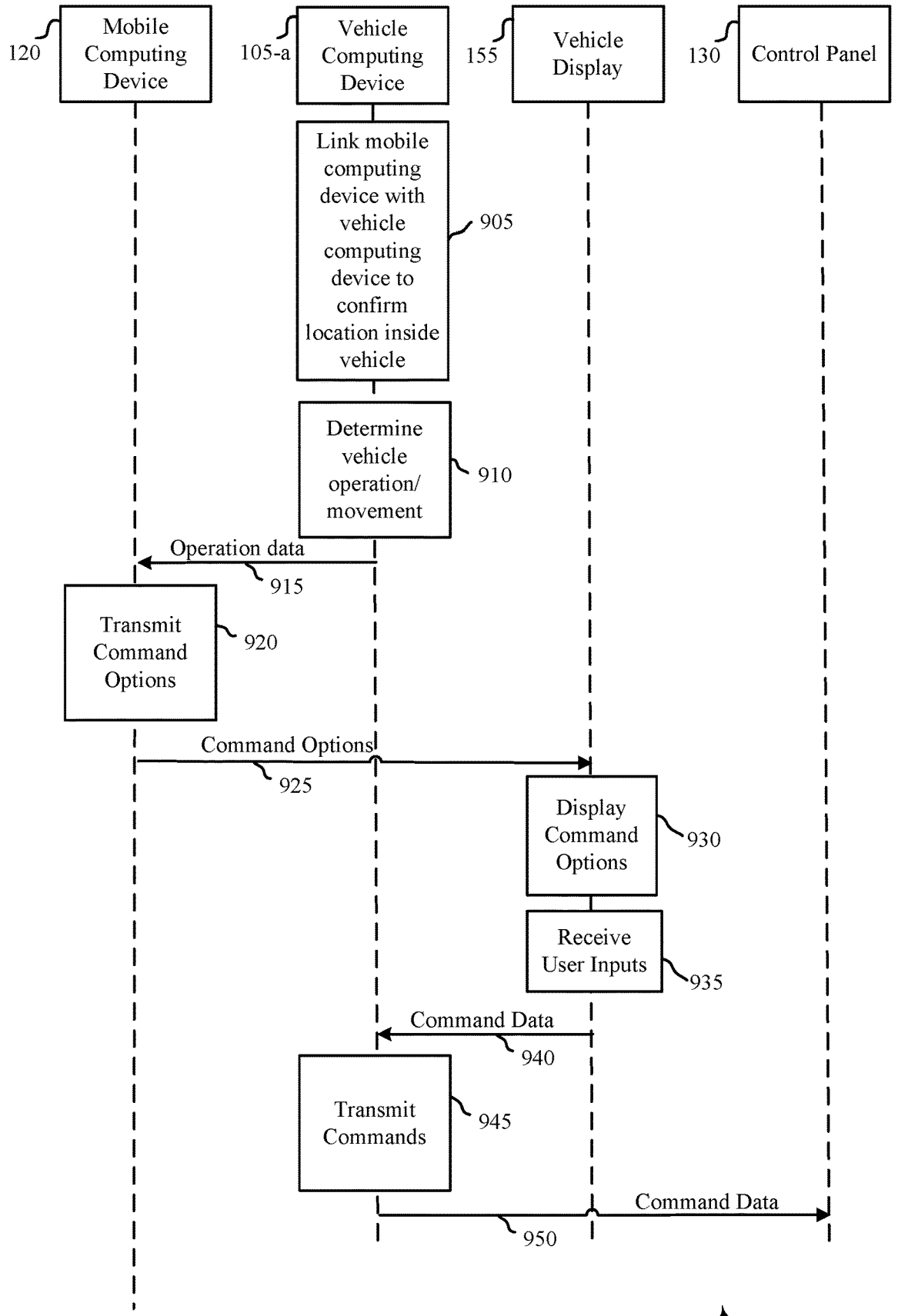
FIG. 9 shows a block diagram of a system relating to a vehicle integration system, in accordance with various aspects of this disclosure.

FIG. 9 shows a system 900 that includes a mobile computing device 120, vehicle computing device 105-*a*, vehicle display 155, and control panel 130, which may be components of the system 100 described above with reference to FIG. 1, and similar components of the systems described with reference to FIGS. 6-8.

At block 905, the system 900 provides linking a mobile computing device 120 with the vehicle computing device 105-*a* to confirm location of the mobile computing device 120 and/or the user inside the vehicle. At block 910, the vehicle computing device 105-*a* determines the vehicle operation and/or movement. The vehicle computing device 105-*a* then transmits operational data 915 to the mobile computing device 120. The mobile computing device 120, transmits command options 925 to the vehicle display 155 at block 920, and vehicle display 155 displays the command options at block 930. The vehicle display 155 receives user inputs at block 935 related to the command options. Vehicle display 155 transmits command data 940 to the vehicle computing device 105-*a*, which transmits commands at block 945 as command data 950 to a control panel 130. The command data 950 may be transmitted to other features or components of a security and/or automation system such as, for example, a back end server, remote computing device, or the like.

System 900 uses the vehicle computing device 105-*a* as the primary component for determining proximity of the user and/or mobile computing device inside the vehicle, determining the vehicle operation and/or movement, and transmitting command data to the security and/or automation system. System 900 may include the mobile computing device 120 operating a mobile computing application that provides command options for controlling the security and/or automation system. In other embodiments, the vehicle computing device 105-*a* may, in place of or in addition to the mobile computing device 120, also operate a mobile computing application that provides command options for controlling the security and/or automation system. The system 900 may also include capability of determining a geo location of the vehicle and/or mobile computing device 120. The geo location information may be used as part of determining when to transmit the command options 925 to the vehicle display 155, and/or making the command options available for selection on the vehicle display 155.

Figure 10:
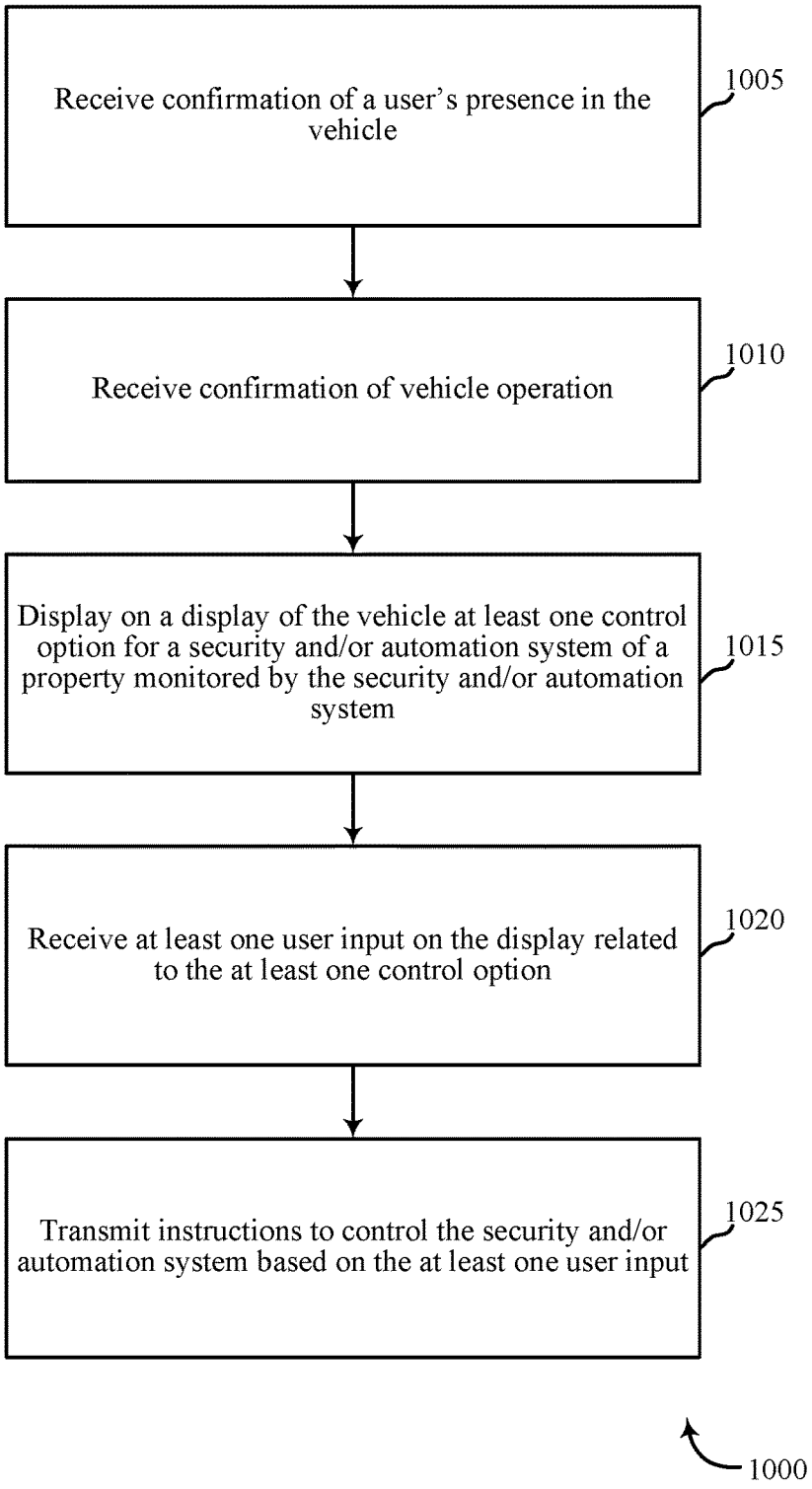
FIG. 10 is a flow chart illustrating a method relating to integrating a vehicle with a security and/or automation system, in accordance with various aspects of this disclosure.

FIG. 10 is a flow chart illustrating an example of a method 1000 for integrating a vehicle computing system and/or vehicle display with a security and/or automation system for a home or other property. The method 1000 may provide capability for an operator of a vehicle to select among one or more command options for controlling the security and/or automation system. For clarity, the method 1000 is described below with reference to aspects of one or more of the systems and methods described with reference to FIGS. 1-9. In some examples, a mobile computing device or vehicle computing device may execute one or more sets of codes to control the functional elements of a security and/or automation system to perform the functions described herein. Additionally, or alternatively, the mobile computing device or vehicle computing device may perform one or more of the functions described below using special-purpose hardware.

At block 1005, the method 1000 may include receiving confirmation of a user's presence in a vehicle. At block 1010, the method 1000 includes receiving confirmation of the vehicle operation. As described above, the vehicle operation may include, for example, an on/off state of the vehicle, a setting of the vehicle transmission, movement of the vehicle, and the like. Block 1015 includes displaying on a display of the vehicle at least one control option for a security and/or automation system of a property monitored by the security and/or automation system. The control option may include, for example, a command option that relates to control of one or more aspects of the security and/or automation system. Block 1020 includes receiving at least one user input on the display related to the at least one control option. Block 1025 includes transmitting instructions to control the security and/or automation system based on the at least one user input. The user input may be converted to command data and the instructions may include the command data.

The operations at blocks 1005 and 1010 may be performed using the mobile computing device 120 and/or the vehicle computing device 105 described with reference to at least FIG. 1. Any of the blocks 1005-1025 described with reference to FIG. 10 may be performed using the control module 215 and/or device 205 described with reference to FIGS. 2-4.

Thus, the method 1000 may provide for remote control of one or more aspects of a security and/or automation of a home or other property using a vehicle display and/or vehicle computing system. The vehicle display may provide a plurality of command or control options to be selected among based at least in part on determining whether a user is present in a vehicle and the vehicle is operating (e.g., moving). It should be noted that the method 1000 is just one implementation and that the operation of the method 1000 may be rearranged or otherwise modified such that other implementations are possible.

Figure 11:
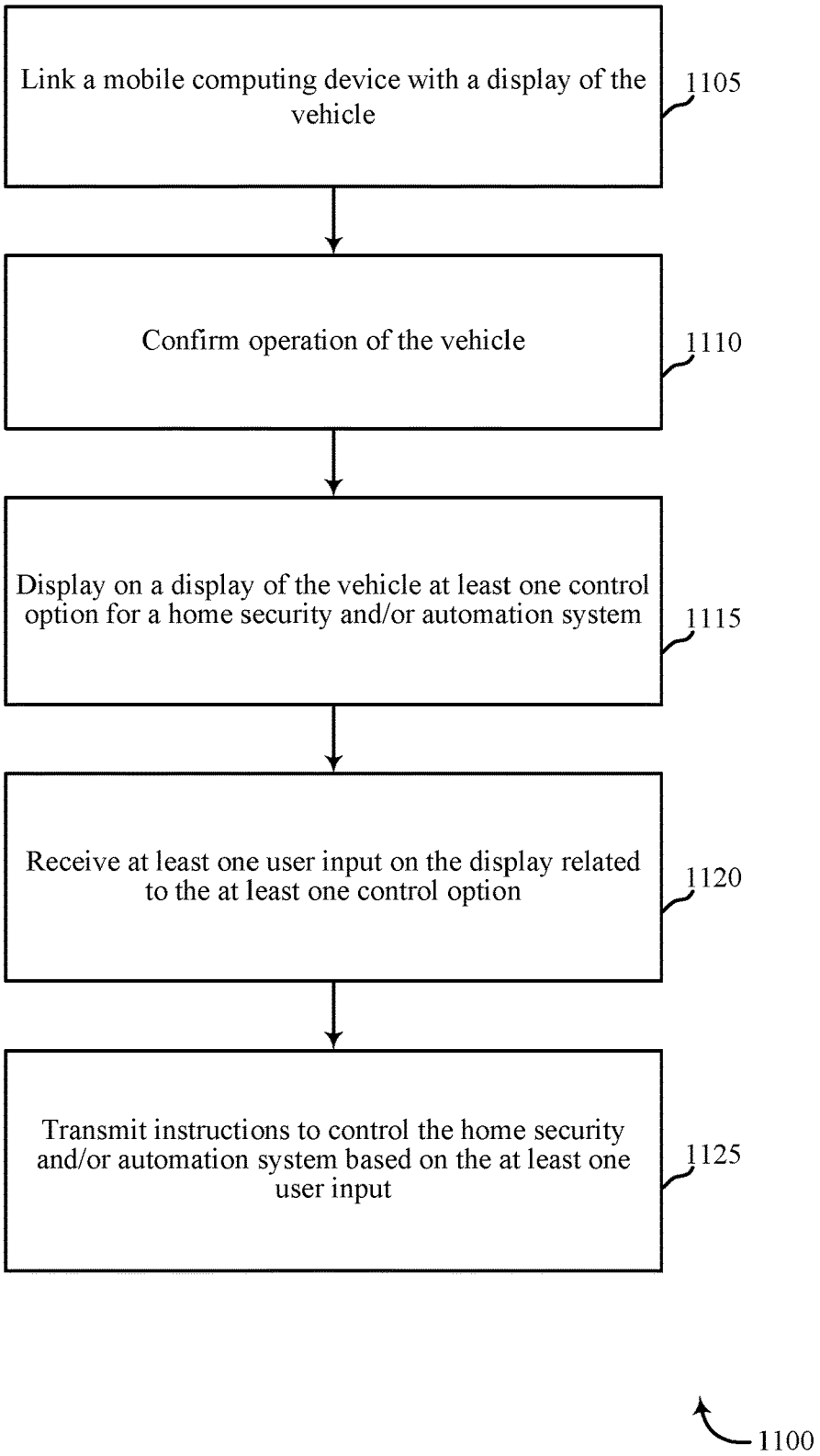
FIG. 11 is a flow chart illustrating a method relating to integrating a vehicle with a security and/or an automation system, in accordance with various aspects of this disclosure.

FIG. 11 is a flow chart illustrating an example of a method 1100 for vehicle integration with a security and/or automation system of a home or other property. The method 1100 may provide for use of a vehicle display as part of selecting among a plurality of command or control options available for controlling the security and/or automation system. In some examples, a mobile computing device, vehicle computing device, or the like may execute one or more sets of codes to control the functional elements of the security and/or automation system to perform the functions described below. Additionally, or alternatively, a control panel, back end server, remote computing device, or the like of a security and/or automation system may perform one or more of the functions described below using special-purpose hardware.

At block 1105, the method 1100 includes linking a mobile computing device with a display of the vehicle. Block 1110 includes confirming operation of the vehicle. Block 1115 includes displaying on a display of the vehicle at least one control option for the security and/or automation system. Block 1120 includes receiving at least one user input on the display of the vehicle related to the at least one control option. Block 1125 includes transmitting instructions to control the security and/or automation system based on the at least one user input. The instructions may be in the form of command or control data related to control of the security and/or automation system.

The operations at blocks 1105, 1110 may be performed using at least one of the mobile computing device and vehicle computing device described herein. The operations at any of blocks 1105-1125 may be performed using the control module 215 and/or computing device 205 described with reference to at least FIGS. 2-4.

Thus, the method 1100 may provide for integration of a vehicle, and particularly a vehicle computing device and/or vehicle display, with a security and/or automation system of a home, business or other property. It should be noted that the method 1100 is just one implementation and that the operations of the method 1100 may be rearranged or otherwise modified such that other implementations are possible.

Figure 12:
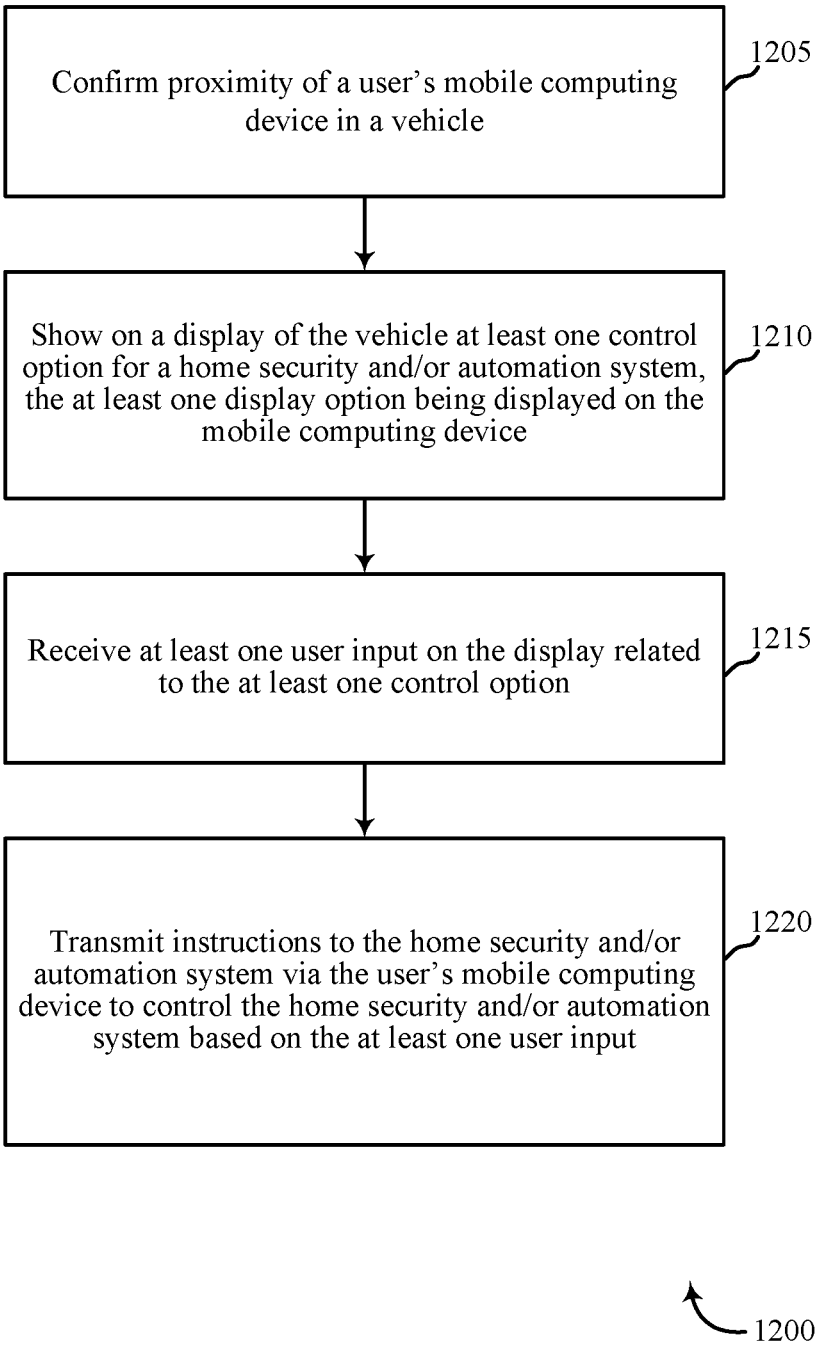
FIG. 12 is a flow chart illustrating an example of a method relating to integrating a vehicle with a security and/or an automation system, in accordance with various aspects of this disclosure.

FIG. 12 is a flow chart illustrating an example of a method 1200 for integration of a vehicle, in particular a vehicle computing device and/or vehicle display, with a security and/or automation system. For clarity, the method 1200 is described below with reference to aspects of one or more of the mobile computing device 120 and vehicle computing device 105 described with reference to at least FIG. 1. In some examples, a control panel, a back end server, or remote computing device, alone or in combination with a computing device 205 and/or control module 215 described herein may execute one or more sets of codes to control the functional elements of the security and/or automation system to perform the functions described below.

At block 1205, the method 1200 may include confirming proximity of a user's mobile computing device in a vehicle. At block 1210, the method 1200 may include showing on a display of the vehicle at least one control option for a security and/or automation system that is also displayed in a mobile computing device. The security and/or automation system may be associated with a home, business, or other property. Block 1215 includes receiving at least one user input on the display related to the at least one control option. Block 1220 includes transmitting instructions to the home security and/or automation system via the user's mobile computing device to control the home security and/or automation system based on the at least one user input.

The transmitted instructions may be in the form of command data for control of the one or more aspects of the security and/or automation system. The various functions of the method 1200 may be carried out using either or both of a mobile computing device and vehicle computing device. The vehicle computing device may incorporate the vehicle display. The operations at blocks 1205-1220 may be performed using the control module 215 and/or the device 205 described with reference to at least FIGS. 2-4.

Thus, the method 1200 may provide for integration of a vehicle, in particular a vehicle computing system and/or vehicle display, with a security and/or automation system. It should be noted that the method 1200 is just one implementation and that the operations of the method 1200 may be rearranged or otherwise modified such that other implementations are possible.

In some examples, aspects from two or more of the methods 1000, 1100, 1200 may be combined and/or separated. It should be noted that the methods 1000, 1100, 1200 are just example implementations, and that the operations of the methods 1000, 1100, 1200 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for controlling a security and/or automation system using a vehicle, comprising:

determining a presence of an occupant of the vehicle;

displaying, on a display of the vehicle, at least one setting associated with the security and/or automation system;

receiving input associated with the at least one setting associated with the security and/or automation system; and transmitting the input to the security and/or automation system.

2. The method of claim 1, further comprising:

determining that the vehicle is in operation, wherein displaying the at least one setting associated with the security and/or automation system is based at least in part on determining that the vehicle is in operation.

3. The method of claim 2, further comprising:

receiving motion data from at least one of a computing system associated with the vehicle, a mobile device located within the vehicle, or one or more sensor units associated with the vehicle, wherein determining that the vehicle is in operation is based at least in part on receiving the motion data.

4. The method of claim 1, further comprising:

determining a location of the vehicle relative to the security and/or automation system, wherein displaying the at least one setting associated with the security and/or automation system is based at least in part on the location of the vehicle.

5. The method of claim 4, wherein transmitting the input to the security and/or automation system is based at least in part on the location of the vehicle.

6. The method of claim 1, further comprising:

establishing a link between the display of the vehicle and a mobile device of the occupant, wherein displaying the at least one setting associated with the security and/or automation system is based at least in part on content displayed on the mobile device.

7. The method of claim 1, wherein transmitting the input to the security and/or automation system comprises transmitting instructions to control at least one setting of the security and/or automation system.

8. The method of claim 1, further comprising:

confirming that the occupant of the vehicle is authenticated by the security and/or automation system, wherein displaying the at least one setting associated with the security and/or automation system is based at least in part on the confirming.

9. The method of claim 8, wherein confirming that the occupant of the vehicle is authenticated by the security and/or automation system is based at least in part on a setting of a mobile device associated with the occupant.

10. The method of claim 1, wherein determining the presence of the occupant of the vehicle is based at least on location information associated with a mobile device of the occupant.

11. An apparatus for controlling a home security and/or automation system using a vehicle, comprising:

a processor;

memory in electronic communication with the processor; and instructions stored in the memory, the instructions being executable by the processor to:

determine a presence of an occupant of the vehicle;

display, on a display of the vehicle, at least one setting associated with the security and/or automation system;

receive input associated with the at least one setting associated with the security and/or automation system; and transmit the input to the security and/or automation system.

12. The apparatus of claim 11, wherein the instructions are further executable by the processor to:

determine that the vehicle is in operation, wherein displaying the at least one setting associated with the security and/or automation system is based at least in part on determining that the vehicle is in operation.

13. The apparatus of claim 12, wherein the instructions are further executable by the processor to:

receive motion data from at least one of a computing system associated with the vehicle, a mobile device located within the vehicle, or one or more sensor units associated with the vehicle, wherein determining that the vehicle is in operation is based at least in part on receiving the motion data.

14. The apparatus of claim 11, wherein the instructions are further executable by the processor to:

determine a location of the vehicle relative to the security and/or automation system, wherein displaying the at least one setting associated with the security and/or automation system is based at least in part on the location of the vehicle.

15. The apparatus of claim 14, wherein transmitting the input to the security and/or automation system is based at least in part on the location of the vehicle.

16. The apparatus of claim 11, wherein the instructions are further executable by the processor to:

establish a link between the display of the vehicle and a mobile device of the occupant, wherein displaying the at least one setting associated with the security and/or automation system is based at least in part on content displayed on the mobile device.

17. The apparatus of claim 11, wherein transmitting the input to the security and/or automation system comprises transmitting instructions to control at least one setting of the security and/or automation system.

18. The apparatus of claim 11, wherein the instructions are further executable by the processor to:

confirm that the occupant of the vehicle is authenticated by the security and/or automation system, wherein displaying the at least one setting associated with the security and/or automation system is based at least in part on the confirming.

19. The apparatus of claim 18, wherein confirming that the occupant of the vehicle is authenticated by the security and/or automation system is based at least in part on a setting of a mobile device associated with the occupant.

20. A non-transitory computer-readable medium storing computer-executable code, the code executable by a processor to:

determine a presence of an occupant of a vehicle;

display, on a display of the vehicle, at least one setting associated with the security and/or automation system;

receive input associated with the at least one setting associated with the security and/or automation system; and transmit the input to the security and/or automation system.

* * * * *